US007013911B2

(12) United States Patent
Wass et al.

(10) Patent No.: US 7,013,911 B2
(45) Date of Patent: Mar. 21, 2006

(54) INTERNAL CROSS OVER VALVE

(76) Inventors: Lloyd G. Wass, P.O. Box 39 (425-7th Ave.), Ironton, MN (US) 56455; Corey Krantz, 271 Olivewood Dr. N., Baxter, MN (US) 56425

( * ) Notice: Subject to any disclaimer, the term of this patent is extended or adjusted under 35 U.S.C. 154(b) by 0 days.

(21) Appl. No.: 10/255,452

(22) Filed: Sep. 26, 2002

(65) Prior Publication Data

US 2003/0056823 A1 Mar. 27, 2003

Related U.S. Application Data

(60) Provisional application No. 60/324,808, filed on Sep. 26, 2001.

(51) Int. Cl.
*F17D 1/00* (2006.01)

(52) U.S. Cl. ..... 137/263; 137/223; 137/597; 137/883

(58) Field of Classification Search ..... 137/263, 137/597, 861, 883, 223; 441/41
See application file for complete search history.

(56) References Cited

U.S. PATENT DOCUMENTS 2,364,211 A * 12/1944 Gustafson ..... 441/41 X
2,444,717 A * 7/1948 Allen ..... 441/41 X
3,550,652 A * 12/1970 Nimylowycz ..... 441/41 X

* cited by examiner

*Primary Examiner*—Kevin Lee
(74) *Attorney, Agent, or Firm*—Gray, Plant, Mooty, Mooty & Bennett PA; Peter Forrest

(57) ABSTRACT

An improved valve and manifold for use in conjunction with inflatable devices such as life rafts, escape slides, white water rafts, kayaks, etc. The invention is specifically an internal cross over valve for inflatable rafts and the like where the valve fluidly connects at least two separate compartments in the inflatable device thereby allowing inflation of the multiple compartments while also providing control of fluid flow therebetween.

20 Claims, 11 Drawing Sheets

Section A-A

DETAIL A

SECTION B-B

SECTION C-C

SECTION D-D

SECTION E-E

SECTION F-F

SECTION H-H

SECTION G-G

SECTION I-I

SECTION J-J

SECTION K-K

INTERNAL CROSS OVER VALVE

This application claims the benefit of provisional application No. 60/324,808, filed on Sep. 26, 2001.

BACKGROUND OF THE INVENTION

1. Technical Field

The invention relates to valves for inflatable devices such as rigid hull inflatable boats (ribs) or other military use boats, inflatable dinghies, life rafts, escape slides, white water rafts, kayaks, etc., and more particularly an internal cross over valve for inflatable rafts and the like where the valve fluidly connects at least two separate compartments in the inflatable device thereby allowing inflation of the multiple compartments while also providing control of fluid flow therebetween.

2. Background Information

For years, numerous different types of inflatable devices have been used for a variety of reasons. For instance, inflatable life rafts have been regularly provided on large aircrafts and water vessels for decades including those used by the military. These inflatable life rafts provide the necessary flotation vessels as would be needed by the passengers of the aircraft or water vessel should the aircraft crash or otherwise end up in water, or should the water vessel sink.

Rigid hull inflatable boats or ribs have also become extremely popular. These and other like boats with inflatable portions are coupled to rigid portions (in one case fiber glass or like material hulls are coupled with inflatable tubes) to define the watercraft. These ribs have increasingly become the inflatable vessel of choice in the military for many operations. In addition, civilian use has also rapidly expanded because these ribs work well as dinghies due to the rigid hull coupled to peripheral inflatable tubes that can readily bump up against docks, other boats and the like without causing damage.

For safety reasons, and also in certain instances as recommended or even required by law, ribs or inflatable rafts for the military or civilian aircraft or watercraft use are formed of at least two distinct and separate inflatable chambers or compartments. These chambers remain completely separate so inflation thereof can be controlled, and so that deflation in the case of a rupture of one of the compartments will not deflate the entire raft but only that one compartment. As a result, inflation valves and mechanisms, often called fill valves, are often provided for each and every compartment or chamber. This requires expensive, bulky equipment attached to each compartment. Alternatively, external cross over inflation valves are available such as those provided by Mirada Research & Manufacturing, Inc. and subject to currently pending provisional patent application No. 60/304,261.

SUMMARY OF THE INVENTION

The present invention is an improved valve assembly called an internal cross over valve assembly capable of controlled inflation of each compartment in an inflatable device coupled with a safety feature prohibiting deflation of all compartments when only one has a hole causing deflation thereof.

These objectives and advantages are obtained by the improved internal cross over valve of the present invention, the general nature of which may be stated as a valve assembly for interconnecting a first fluid compartment to a second fluid compartment in an inflatable device where the valve assembly includes a valve body attachable to the inflatable device, the valve body including a pair of passages therein connected to the first fluid compartment and the second fluid compartment; and a valve mechanism for fluidly connecting the pair of passages when desired to provide for fluid flow therebetween.

BRIEF DESCRIPTION OF THE DRAWINGS

The preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 34:
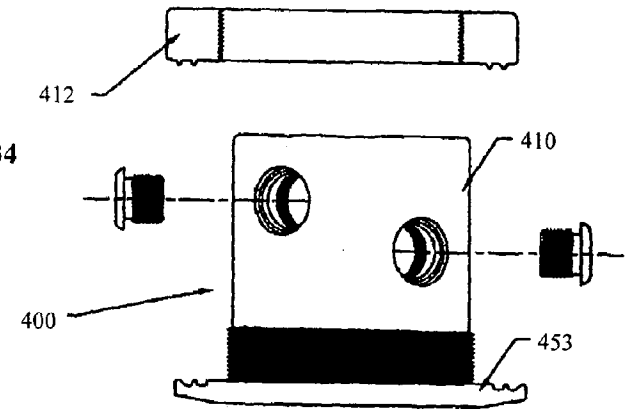
FIG. 34 is an exploded view of a third embodiment of an internal cross over valve assembly.
Figure 35:
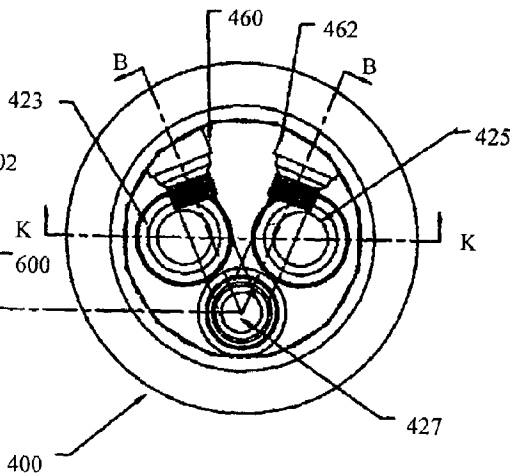
FIG. 35 is a sectional view of the internal cross over valve assembly of FIG. 34 taken along line K—K in FIG. 34.
Figure 35:
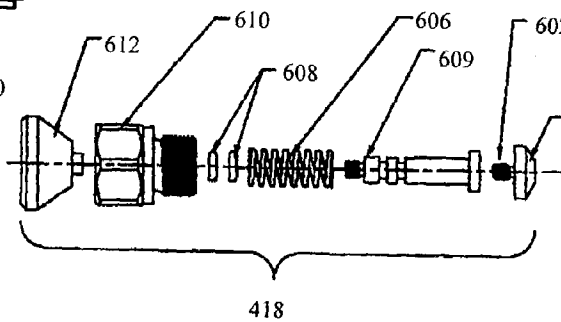
Figure 35:
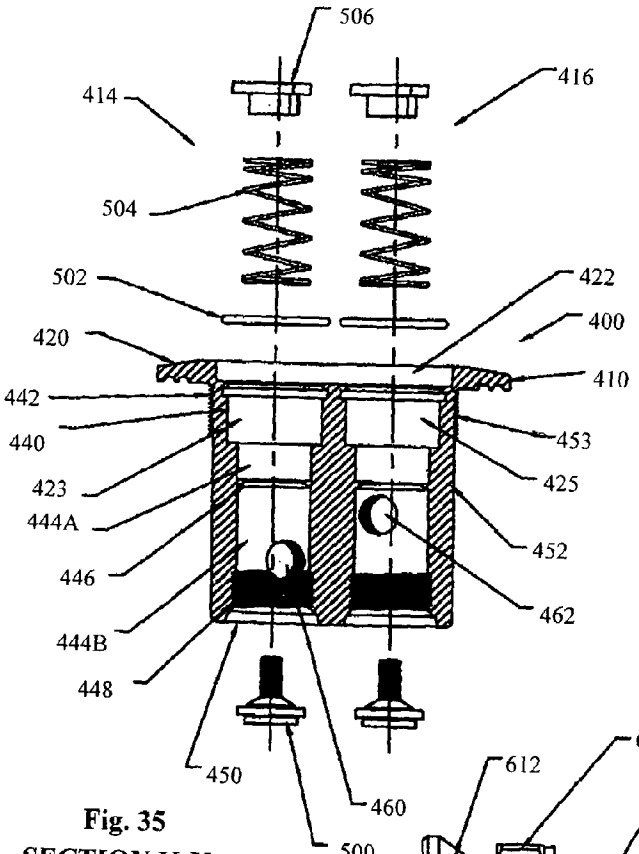
Figure 36:
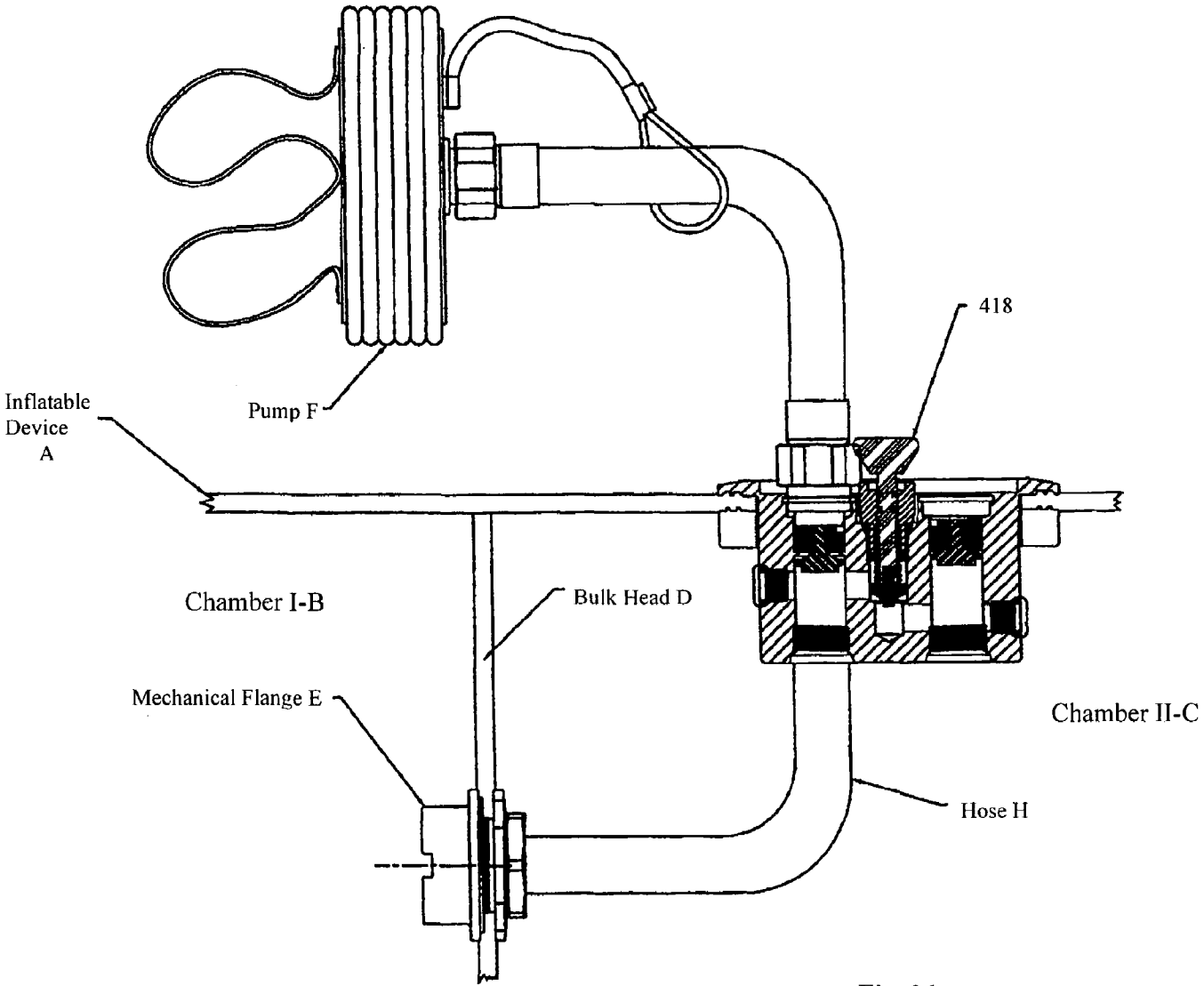
FIG. 36 is an environmental view of the internal cross over valve assembly of FIGS. 34–35 affixed within one possible environment, namely an inflatable device with multiple chambers and where a pump for inflation purposes is also shown.

The improved internal cross over valve assembly for use in inflation devices such as life rafts, escape slides, white water rafts, kayaks, and the like is shown in the Figures in three different embodiments, namely a first embodiment shown in FIGS. 1–15, a second embodiment shown in FIGS. 16–33, and a third embodiment shown in FIGS. 34–36. FIGS. 1–35 are various views of each of the embodiments, or one or more parts thereof. FIG. 36 is an environmental view of the third embodiment of the internal cross over valve assembly affixed within an inflatable device A with multiple chambers B and C separated by a bulk head D having a flange E therein where a pump F is provided to inflate the chambers via the assembly. The first and second embodiments may similarly be affixed to inflatable device A or a similar inflatable device as described for the third embodiment. In general, the internal cross over valve assembly of any of the three embodiments is inserted within an aperture in and adhered to the inflatable device via crimping, clamping, sandwiching, adhering, gluing, ultrasonic welding or other methods known by one of skill in the art.

The first embodiment of the internal cross over valve assembly is shown in FIGS. 1–15 and indicated as 10. Internal cross over valve assembly 10 includes a top flange 12, a valve retainer 14, and a valve spool 16.

Figure 6:
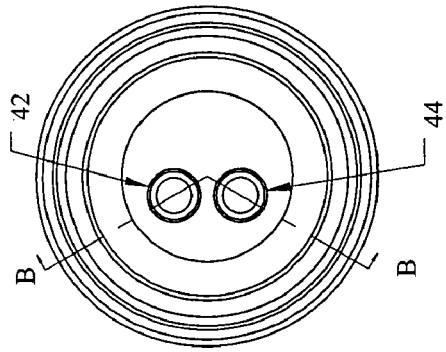
FIG. 6 is a bottom view of the top flange of the internal cross over valve assembly shown in FIGS. 1–3; portion of the internal cross over valve assembly shown in FIGS. 1–3 taken along line B—B in FIG. 6.
Figure 4:
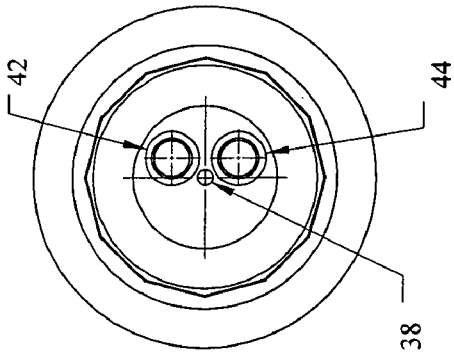
FIG. 4 is a top view of the top flange of the internal cross over valve assembly shown in FIGS. 1–3.

Top flange 12 is best shown in FIGS. 4–8. Top flange is of a stepped cylindrical design such that the flange 12 includes a circular flange 20 with an aperture 22 in the center thereof defining a well 24 that includes a larger diameter portion 26, a ledge 28, an intermediate diameter portion 30, a seat 32, and a smaller diameter portion 34. At the base 36 of the well is a threaded shaft 38 extending only partially into flange bottom 40 as best shown in FIG. 4, and a pair of pores 42 and 44 which are offset as is best shown in FIGS. 4 and 6. Each port 42 and 44 includes a smaller diameter section 46 adjacent the base 36 and extending to a larger diameter threaded section 48 extending through to flange bottom 40. In base 36 around each of the ports 42 and 44 is an o-ring groove 50.

Figure 5:
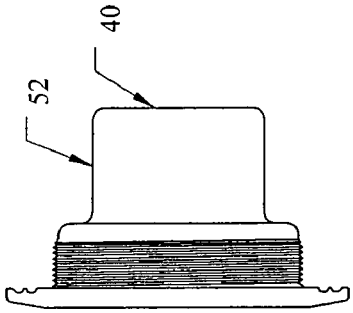
FIG. 5 is a side view of the top flange of the internal cross over valve assembly shown in FIGS. 1–3.
Figure 8:
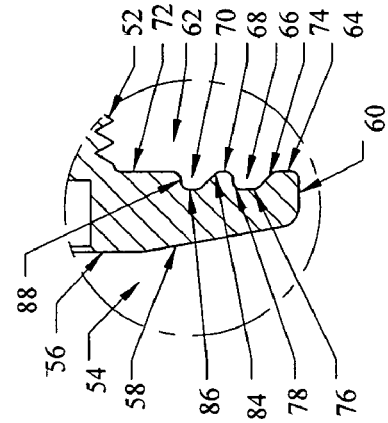
FIG. 8 is an enlarged sectional view of a portion of the top flange of the internal cross over valve assembly shown in FIGS. 1–3.
Figure 7:
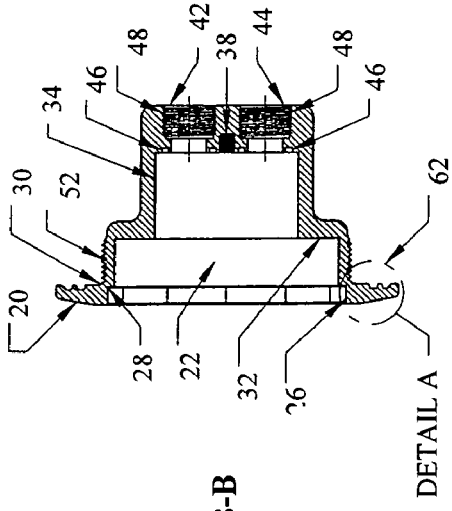

An outside wall 52 of the intermediate diameter portion 30 is threaded. The surface of the circular flange 20 as best shown in FIGS. 5 and 7 includes a top surface 54 of a flat inner area 56 and a tapered outer area 58, a side surface 60, and an underneath surface 62 having a unique sealing design. The sealing design is best shown in FIG. 8 to include in cross section an outermost flat surface 64, a first groove 66, an island 68, a second groove 70, and an innermost flat surface 72. The first groove 66 is defined by a tapered surface 74 rounding into a first base surface 76 rounding into a first wall 78. The island 68 has rounded transitions 80 and 82 from first groove 66 and second groove 70, respectively. The second groove 70 is defined by a second wall 84 rounding into a second base 86 rounding into a third wall 88. This unique design provides sealing between the top flange 12 and the valve retainer 14.

Figure 9:
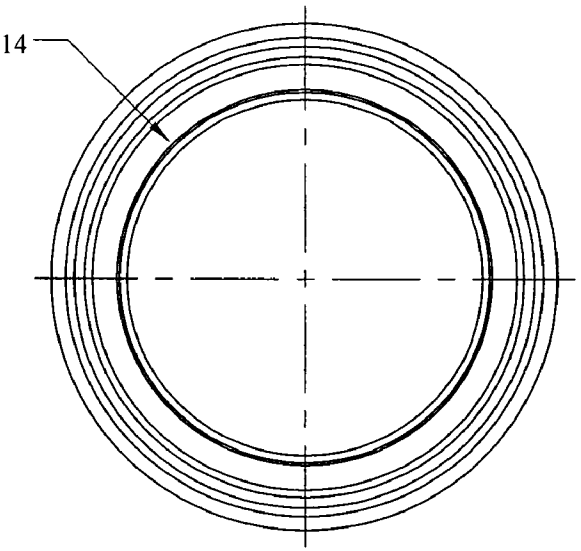
FIG. 9 is a view of the sealing surface of the valve retainer of the internal cross over valve assembly shown in FIGS. 1–3.
Figure 11:
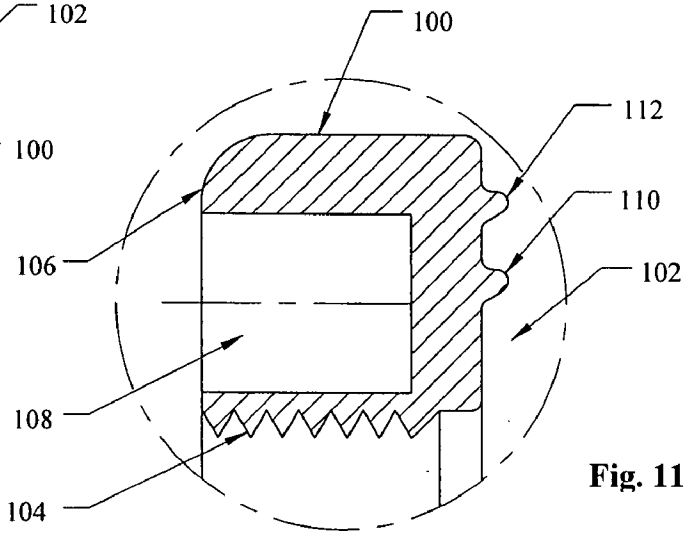
FIG. 11 is an enlarged sectional view of a portion of the valve retainer of the internal cross over valve assembly shown in FIGS. 1–3.
Figure 10:
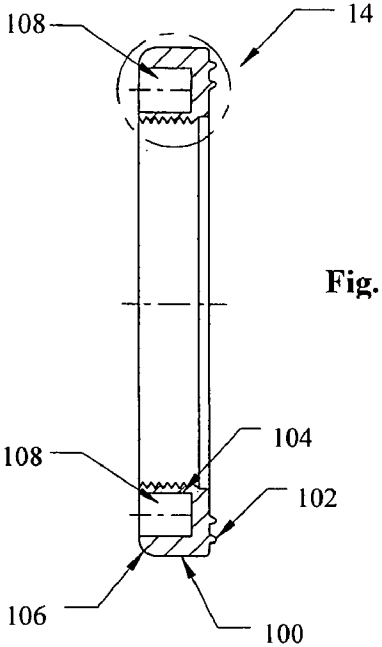
FIG. 10 is a sectional view of the valve retainer of the internal cross over valve assembly shown in FIGS. 1–3.

Valve retainer 14 as best shown in FIGS. 9–11 is a ring-like structure having an outer surface 100, a sealing surface 102, a threaded inner surface 104, and a surface 106 including holes 108 therein. The threads of the threaded inner surface 104 are corresponding to and threadable on the outside wall 52 of the intermediate diameter portion 30. The sealing surface 102 includes a pair of annular sealing nubs 110 and 112 which are designed to sealingly fit within first groove 66 and second groove 70. The holes 108 are provided to function with a spanner wrench.

Valve spool 16 as best shown in FIGS. 12–15 is a cylindrical body 120 having, a first and second end 122 and 124, respectively, with an aperture 126 extending therebetween. The first end 122 includes a circular flange 128 extending radially outward from the aperture 126 at first end 122. The circular flange has a top surface 130 in plane with the first end, and a bottom surface defining a seat surface 132.

The cylindrical body 120 has an outer surface 134 extending from the bottom surface of the flange to the second end 124. An annular groove 136 is within the outer surface 134 proximate the second end 124.

Aperture 126 includes a well 140 extending from the first end into the cylindrical body, and a port 142 of a smaller diameter than the cylindrical body and extending from a base 144 of the well 140 to the second end 124. At least a portion of the well 140 is threaded.

Figure 13:
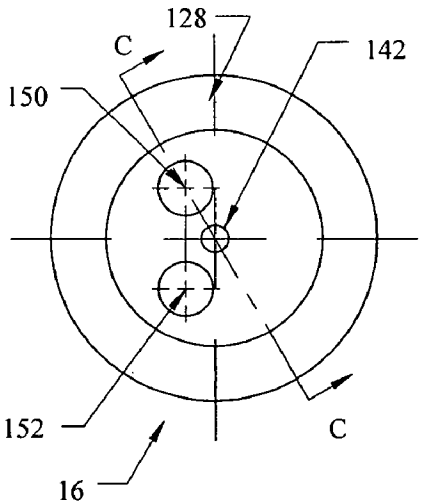
FIG. 13 is a bottom view of the valve spool of the internal cross over valve assembly shown in FIGS. 1–3.

A pair of ports 150 and 152 extend into cylindrical body 120 from second end 124 to the base 144. These ports are offset as best shown in FIGS. 12–13 and 15, and may or may not fully open into the well 140, and in the embodiment shown do not fully open and instead provide a less than circular path from the port into the well as best shown by FIG. 12.

Figure 14:
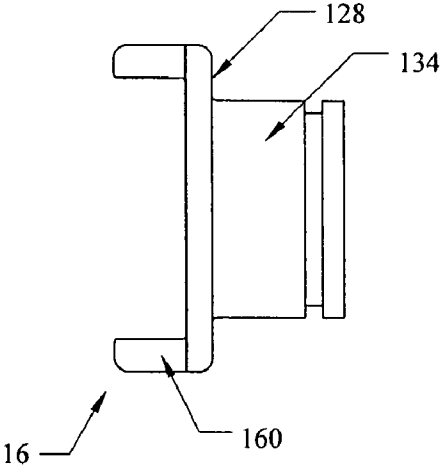
FIG. 14 is a side view of the valve spool of the internal cross over valve assembly shown in FIGS. 1–3.
Figure 12:
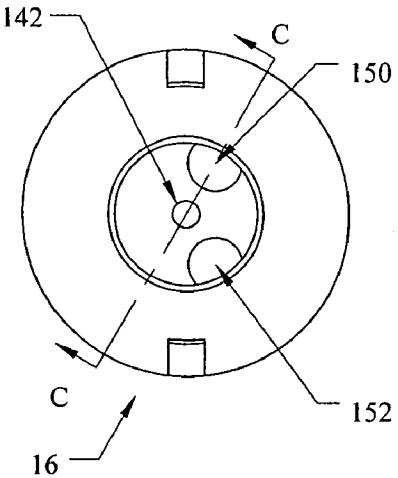
FIG. 12 is a top view of the valve spool of the internal cross over valve assembly shown in FIGS. 1–3.
Figure 15:
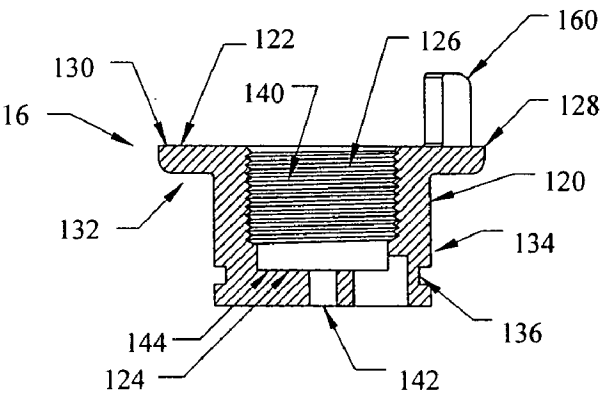
FIG. 15 is a sectional view of the valve spool of the internal cross over valve assembly shown in FIGS. 1–3 taken along line C—C in FIGS. 12–13.

A pair of tabs 160 and 162 extend upward out of the top surface 130 as shown in FIGS. 12 and 14–15. These tabs stick out from the assembly to function as fingers or handles such that a user may actuate the valve spool.

Figure 2:
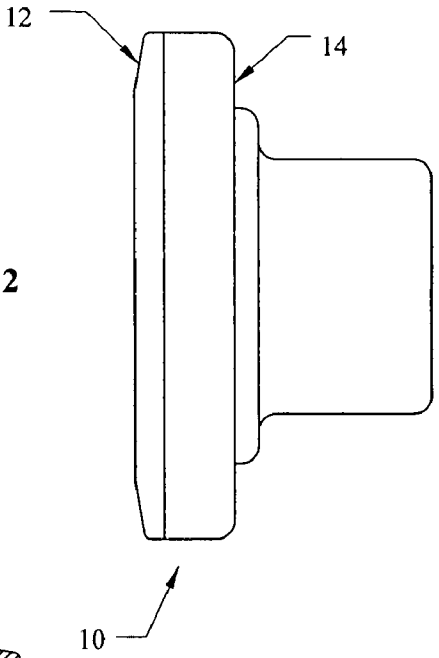
FIG. 2 is a side view of the internal cross over valve assembly of FIG. 1.
Figure 3:
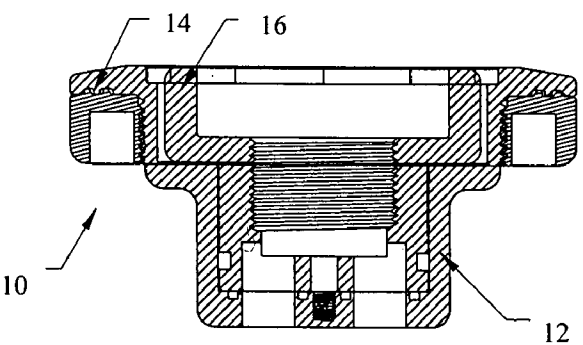
FIG. 3 is a sectional view of the internal cross over valve assembly of FIGS. 1–2 taken along line A—A in FIG. 1.
Figure 1:
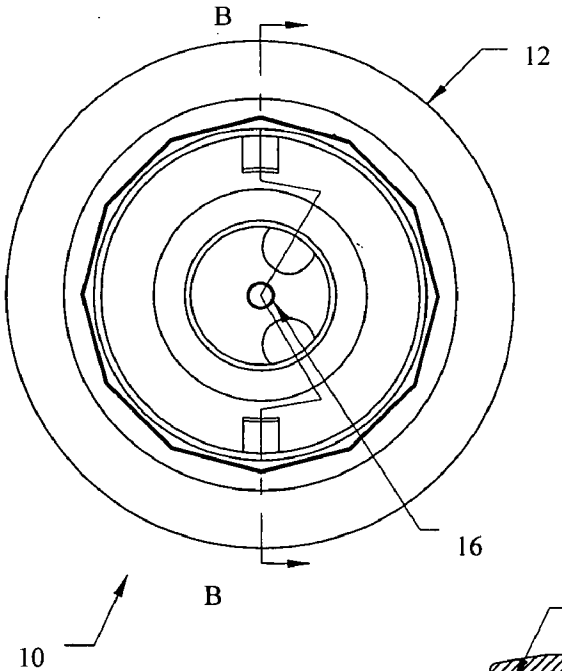
FIG. 1 is a top view of a first embodiment of an internal cross over valve assembly.

In assembly as best shown in FIG. 3, top flange 12 is placed within a hole in the fabric of an inflatable device such that the circular flange 20 seats on the outer surface of the inflatable device around the hole in the fabric. Valve retainer 14 is slipped over the outside surface of the flange 12 and threaded onto the outside wall 52. The fabric is pinched and sealed in between the underneath surface 62 and the sealing surface 102. The first groove 66, island 68, and second groove 70 function with annular sealing nubs 110 and 112 to seal the fabric within the valve.

Valve spool 16 seats within the well 24 whereby the circular flange 128 and specifically seat surface 132 seats on seat 32. A fastener 170 is inserted through port 142 and threaded into threaded shaft 38 to pivotally connect the valve spool 16 to the top flange 12. An annular seal 172 is positioned within groove 136 for sealing the valve spool 16 to the top flange 12

In operation, the valve 10 functions by pivoting the valve spool 16 within the top flange 12. This pivoting allows for three variables, namely (1) no alignment of ports 42 and 44 in top flange 12 with ports 150 and 152 in valve spool 16 thereby allowing no flow through valve 10, (2) alignment of one of ports 42 and 44 in top flange 12 with one of ports 150 and 152 in valve spool 16 thereby allowing flow through one aligned passage in valve 10 into one chamber or compartment as defined below, or (3) alignment of port 42 in top flange 12 with port 150 in valve spool 16, and alignment of port 44 in top flange 12 with port 152 in valve spool 16 thereby allowing flow through two aligned passages in valve 10 whereby one passage provides flow into one chamber or compartment as defined below and the other passage provides flow into the other chamber or compartment as defined below.

Alternatively to the above described valve retainer 14 embodiment which sandwiches the fabric between the retainer 14 and the top flange 12, the top flange 12 may be used without a retainer where at least the circular flange 20 is of a weldable material such that the flange may be welded, adhered, glued or otherwise affixed to the fabric rather than clamped or sandwiched.

All components of this first embodiment except for seals are of a rigid design and material such as metal (stainless steel, steel, brass, aluminum, or other metals typically used for such components) or a rigid plastic.

A second embodiment of the internal cross over valve assembly is shown in FIGS. 16–33 and indicated as 200. Internal cross over valve assembly 200 includes a top flange 210, a valve body 212, an optional sleeve 215, and a valve spool 216.

Figure 21:
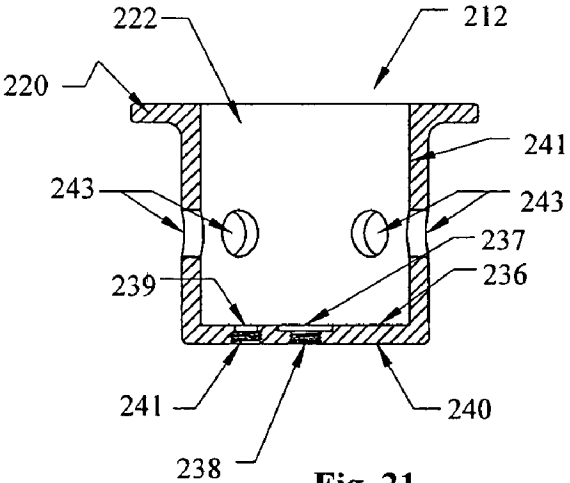
FIG. 21 is a sectional view of the valve body of the internal cross over valve assembly shown in FIGS. 16–18 taken along line E—E in FIG. 19.
Figure 19:
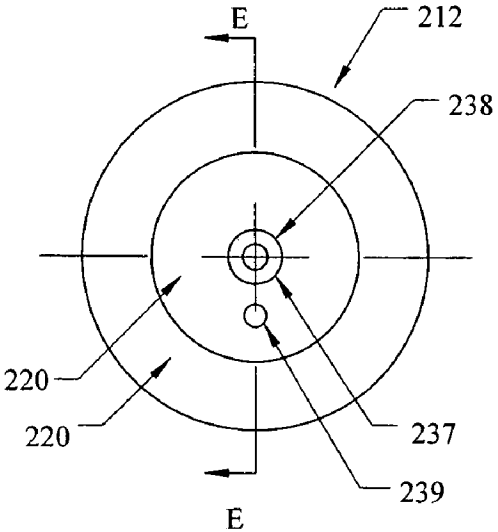
FIG. 19 is a top view of the valve body of the internal cross over valve assembly shown in FIGS. 16–18.
Figure 20:
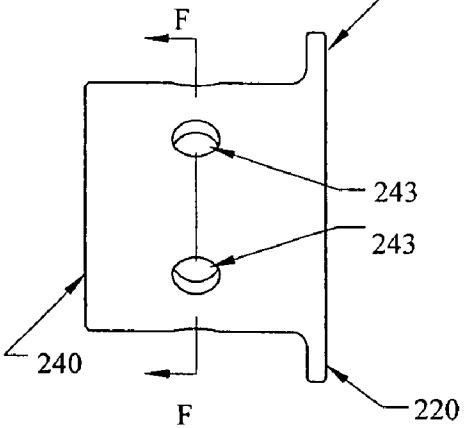
FIG. 20 is a side view of the valve body of the internal cross over valve assembly shown in FIGS. 16–18.
Figure 22:
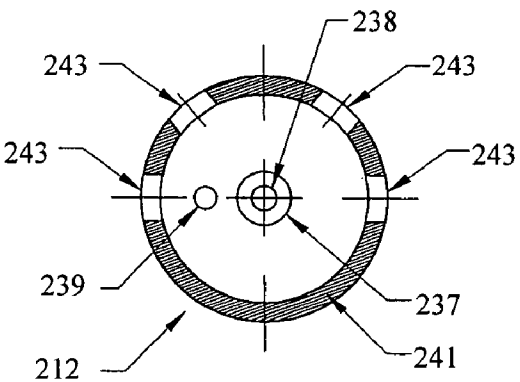
FIG. 22 is a sectional view of the valve body of the internal cross over valve assembly shown in FIGS. 16–18 taken along line F—F in FIG. 20.
Figure 27:
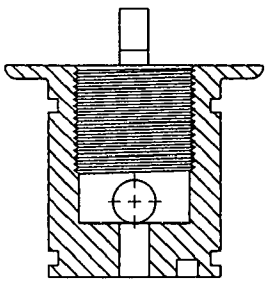
FIG. 27 is a sectional view of the valve spool of the internal cross over valve assembly shown in FIGS. 16–18 taken along line H—H in FIG. 25.
Figure 24:
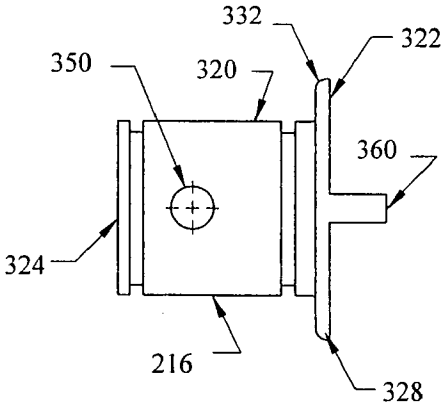
FIG. 24 is a second side view of the valve spool of the internal cross over valve assembly shown in FIGS. 16–18 taken at approximately 90° of rotation about a center, axis in relation to FIG. 23.
Figure 23:
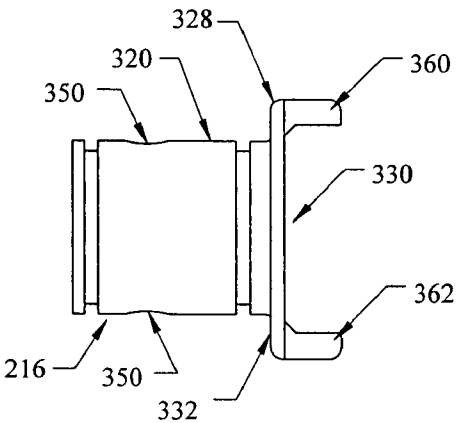
FIG. 23 is a side view of the valve spool of the internal cross over valve assembly shown in FIGS. 16–18.

Valve body 212 is best shown in FIGS. 18–22. Valve body 212 is generally cylindrical and of a stepped design such that the valve body 212 includes a circular flange or catch region 220 with an aperture 222 in the center thereof defining a well 224 having an annular side wall 241 and a circular base 236. At the base 236 of the well is a sunken region 237 with a threaded shaft 238 substantially centered within the well and extending through to a valve body bottom 240 as best shown in FIG. 21 where the shaft 238 is of a smaller diameter than the sunken region 237. The base 236 also includes a second sunken region 239 with a threaded shaft 241 offset within the well and extending through to valve body bottom 240 where the shaft 241 is of a larger diameter than the sunken region 239. Valve body 212 further includes a plurality of holes 243, in the embodiment shown four, in annular side wall 241 as best shown in FIGS. 20–22.

Figure 16:
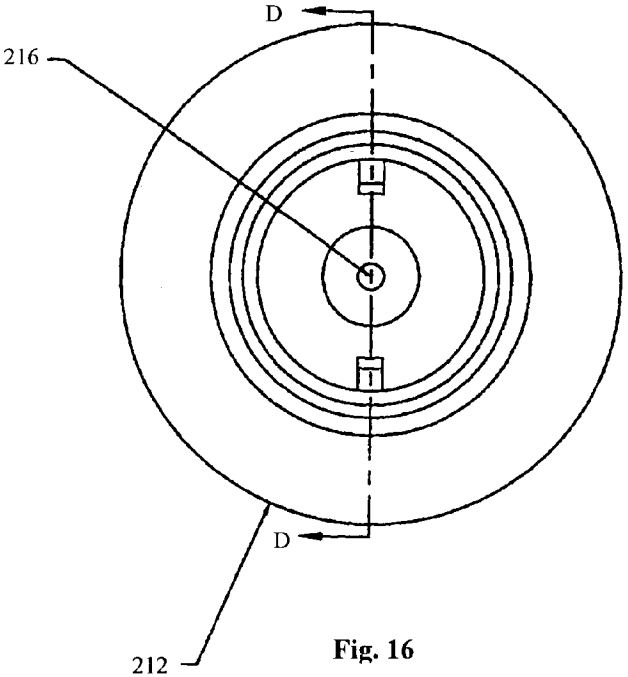
FIG. 16 is a top view of a second embodiment of an internal cross over valve assembly.
Figure 17:
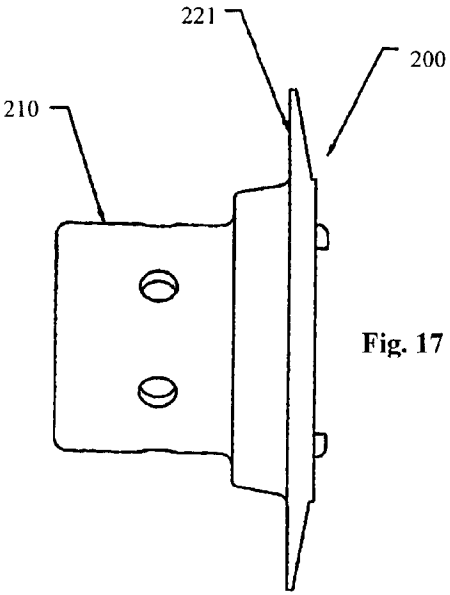
FIG. 17 is a side view of the internal cross over valve assembly of FIG. 16.
Figure 18:
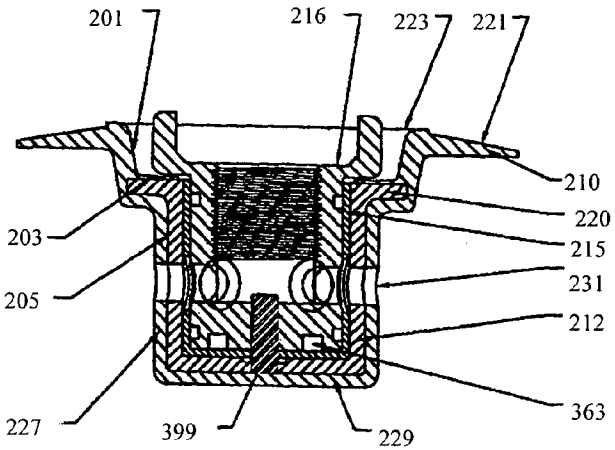
FIG. 18 is a sectional view of the internal cross over valve assembly of FIG. 16 taken along line D—D in FIG. 16.

Top flange 210 is best shown in FIGS. 16–18 and is made of a flexible material such as a rubber, neoprene or other plastic material. Top flange 210 is of a stepped cylindrical design that includes a circular flange 221 with an aperture 223 in the center thereof defining a well 225 that includes an annular wall 227 and a circular base 229. Annular wall 227 includes a larger diameter portion 201, a thin ledge or seat 203 extending inward from the annular wall and defining a valve body seating groove 205, and a smaller diameter portion 207. Top flange 210 further includes a plurality of holes 231, in the embodiment shown four, in annular side wall 227 as best shown in FIGS. 20–22. These holes are configured to be of the same size and spacing as holes 243.

The top flange 210 is shaped so as to snuggly surround the valve body 212 as is shown in FIGS. 16–18. Circular flange 220 seats within groove 205 as best shown in FIG. 18 while valve spool 216 seats on top of thin ledge 203.

Valve spool 216 as best shown in FIGS. 23–27 is a substantially cylindrical body 320 having a first and second end 322 and 324, respectively, with an aperture 326 extending therebetween. The first end 322 includes a circular flange 328 extending radially outward from the aperture 326 at first end 322. The circular flange has a top surface 330 in plane with the first end, and a bottom surface defining a seat surface 332.

The cylindrical body 320 has an outer surface 334 extending from the bottom surface of the flange to the second end 324. A first annular groove 336 is within the outer surface 334 proximate the bottom surface 332, and a second annular groove 337 is within the outer surface, 334 proximate the second end 324

Aperture 326 includes a well 340 extending from the first end into the cylindrical body, and a port 342 of a smaller diameter than cylindrical body and extending from a base 344 of the well 340 to the second end 324. At least a portion of the well 340 is threaded.

A plurality of ports 350 extend into the well 340 of cylindrical body 320 from outer surface 334. In the embodiment shown, the number of ports 350 is four and generally corresponds to be of the same number, size and spacing as holes 231 and 243. In the embodiment shown, the holes are adjacent the seat defined by the transition from the well 340 to the port 342.

A pair of tabs 360 and 362 extend upward out of the top surface 330 as shown in FIGS. 23–27. These tabs stick out from the assembly to function as fingers or handles such that a user may actuate the valve spool.

Figure 25:
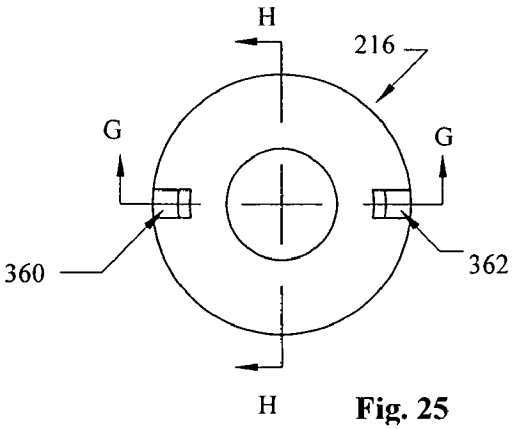
FIG. 25 is a top view of the valve spool of the internal cross over valve assembly shown in FIGS. 16–18.
Figure 25A:
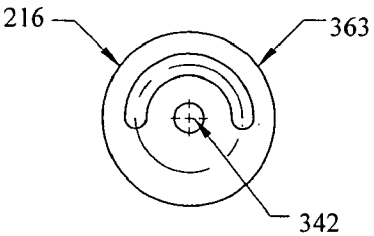
FIG. 25A is a bottom view of the valve spool of the internal cross over valve assembly shown in FIGS. 16–18.
Figure 26:
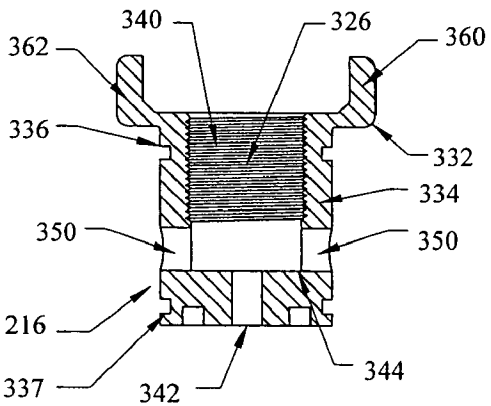
FIG. 26 is a sectional view of the valve spool of the internal cross over valve assembly shown in FIGS. 16–18 taken along line G—G in FIG. 25.
Figure 30:
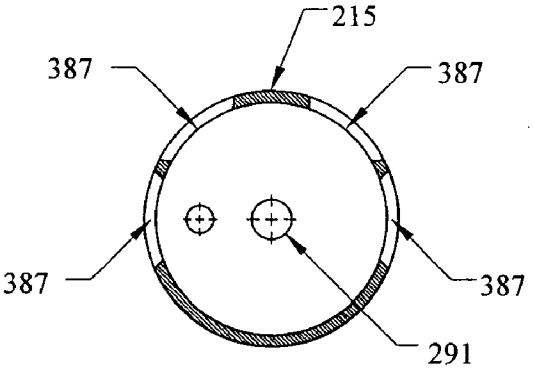
FIG. 30 is sectional view of the valve sleeve of the internal cross over valve assembly shown in FIGS. 16–18 taken along line, I—I in FIG. 28.
Figure 31:
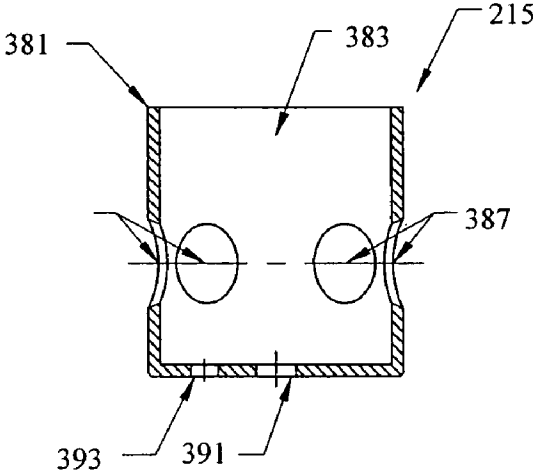
FIG. 31 is sectional view of the valve sleeve of the internal cross over valve assembly shown in FIGS. 16–18 taken along line J—J in FIG. 29.
Figure 29:
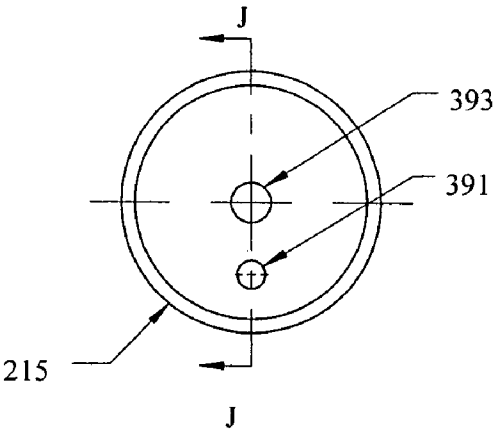
FIG. 29 is an end view of the valve sleeve of the internal cross over valve assembly shown in FIGS. 16–18.
Figure 28:
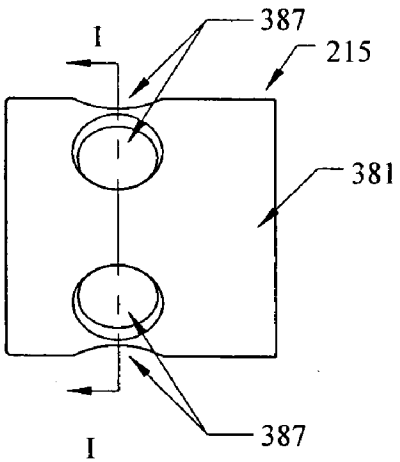
FIG. 28 is a side view of the valve sleeve of the internal cross over valve assembly shown in FIGS. 16–18.
Figure 33:
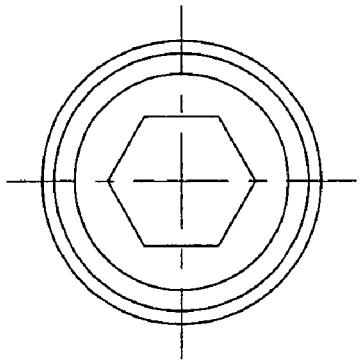
FIG. 33 is an end view of the valve pin of the internal cross over valve assembly shown in FIGS. 16–18.
Figure 32:
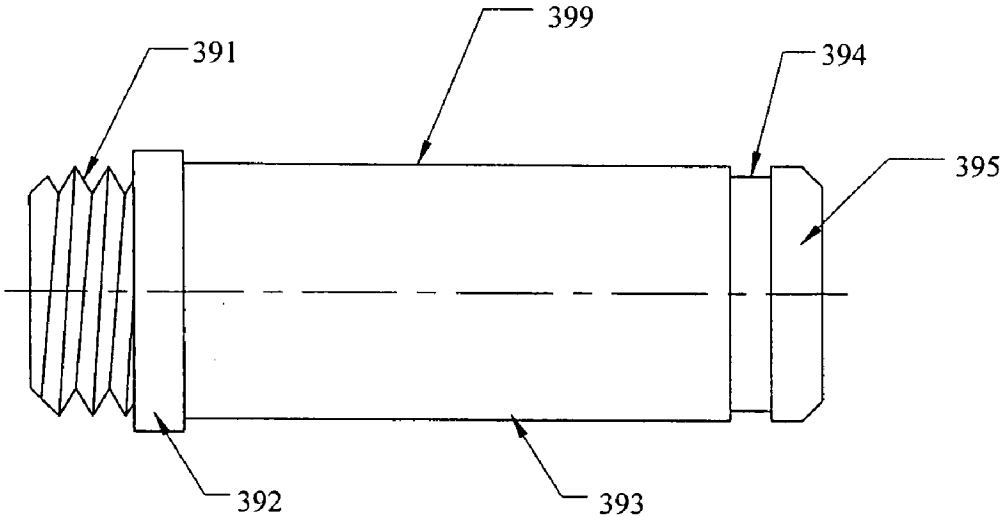
FIG. 32 is a side view of the valve pin of the internal cross over valve assembly shown in FIGS. 16–18.

As best shown in FIG. 25A, valve spool 216 includes a guide slot or groove 363 in the second end 324. In the embodiment shown, this slot is substantially semi-circular.

Optional sleeve 215 may be provided in between valve body 212 and valve spool 216 as is shown in FIG. 18. Sleeve 215 is shown in FIGS. 28–31 as a cylindrical sleeve 381 with a well 383 defined therein by end or base 385. Sleeve 215 includes a plurality of ports 387 extending into the well 383 from its outer surface. In the embodiment shown, the number of ports 387 is four and generally corresponds to be of the same number, size and spacing as holes 231, 243 and 350. The sleeve also includes a shaft 391 substantially centered within the well and extending through the base 385 and a shaft 393 offset within the well and also extending through the base.

In assembly as best shown in FIG. 18, flange 210 is placed within a hole in the fabric of an inflatable device and adhered to the fabric by ultrasonic welding, adhesive or the like. Securely seated within the flange 210 is valve body 212. Optional sleeve 215 may be seated within valve body 212.

Valve spool 216 seats within the either optional sleeve 215 or valve body 212, whereby a pin 399 with a threaded head 391, first stop 392, shaft 393, groove 394 and end head 395 pivotally secures the valve spool 216 to valve body 212. Annular seals 398 are positioned within grooves 336 and 337 for sealing the valve spool 216 to either the sleeve 215 or valve body 212.

In operation, the valve 200 functions by pivoting the valve spool 216 within the valve body 212. This pivoting allows for three variables, namely (1) no alignment of ports 243 (and 387 if a sleeve is present) with ports 350 thereby allowing no flow through valve 200, (2) alignment of some of ports 243 (and 387 if a sleeve is present) with some of ports 350 thereby allowing flow through some aligned passages in valve 200 into one chamber or compartment as defined below, or (3) alignment of all of ports 243 (and 387 if a sleeve is present) with all of the respective ports 350 thereby allowing flow through all aligned passages in valve 200 whereby this provides flow into all chambers or compartments.

A pin 379 pivots in groove 363 to limit the pivotal motion of the valve spool 216 within the valve body 212. The pin is threaded into port 241 (via hole 393 in optional sleeve 215 when present).

All components of this second embodiment except for one or more of seals, top flange 210, and sleeve 215 are of a rigid design and material such as metal (stainless steel, steel, brass, aluminum, or other metals typically used for such components) or a rigid plastic. One or more of seals, top flange 210, and sleeve 215 may be of a rubber or plastic design, or in the case of top flange 210, and sleeve 215 of a rigid design and material such as metal (stainless steel, steel, brass, aluminum or other metals typically used for such components) or a rigid plastic.

A third embodiment of the internal cross over valve assembly is shown in FIGS. 34–36 and indicated as 400. Internal cross over valve assembly 400 includes a valve body 410, a retainer ring 412, a pair of topping or like valves 414 and 416, a cross over valve 418, and plugs 420.

Valve body 410 is preferably a unitary valve body of a cylindrical design that includes a circular flange 420 with a sunken recess 422 in the center thereof. Three passages 423, 425 and 427 extend from this recess to an opposite end of the body 410. The valve body includes an outside wall 452 with a threaded portion preferably adjacent the underneath portion of the flange 420 as shown in FIG. 35. This underneath portion of the flange may further include a unique sealing design substantially similar to that described above for the first embodiment that mates with a retainer ring 412 substantially identical to retainer 14 in the first embodiment.

Passages 423 and 425 are for receiving topping valves 414 and 416 respectively, and are identical in nature so only 423 will be described below. In one embodiment, passage 423 includes a larger diameter portion 440 with a groove 442 therein, a smaller diameter portion 444 with a ledge 446 therein dividing the portion 444 into an upper portion 444A and a lower portion 444B, a threaded section 448, and a mouth 450 with tapered walls for receiving a poppet in the topping valve. It is contemplated that the passage 423 may taken on different configurations so long as the passage provides the necessary support structure and sealing faces to receive a topping valve and allow it to properly function.

A transverse air passage 460 intersects passage 423, while a transverse air passage 462 intersects passage 425. Both passages 460 and 462 intersect passage 427 in which the cross over valve seats. The passages 460 and 462 intersect their respective passages 423 and 425 at different cross sectional locations along the axial length of the valve body 410 as shown in FIG. 35.

Topping valves 414 and 416 are of an identical design and it is contemplated that any type of topping or similar fill valve may be used. In the embodiment shown, the topping valves include a poppet 500, a seal 502, a spring 504 and a retainer 506. Other designs will readily function so long as the valve includes a poppet or other part capable of sealing mouth 450, and a bias or other mechanism that holds the poppet in place except when it is desired to fill through that given passage whereby the poppet is displaceable from the mouth to allow air to pass therethrough.

Passage 427 is designed to receive cross over valve 418 as is shown in FIG. 36 whereby the passage includes a seat 429. Cross over valve 418 is any valve capable of sealing the passage 427 including as to any flow between passages 460 and 462 therein. In the embodiment shown, cross over valve 418 includes a poppet 600 with a threaded shaft 602, a stem 604, a spring 606, seals 608, a body 610 and a handle 612. The cross over valve is biased or otherwise positioned to block flow between passages 460 and 462 which is accomplished in this embodiment by poppet 600 seating in seat 429. Movement of the stem within the passage 427 unseats and thus opens up the flow between the passages 460 and 462 thereby allowing cross over as is shown in FIG. 36.

Plugs 420 are provided to cap off passages 460 and 462 where they extend to the environment. These are only necessary where the passages 460 and 462 are bored from the outside and thus open to the environment.

Environmentally, any of the above three valves are used as follows. The valve 10, 200 or 400 is placed as described above within a hole in the fabric of one chamber or compartment (chamber C as shown in FIG. 36) of an inflatable device A. A hose H (best shown in FIG. 36 for the third embodiment) is sealingly connected to one of the ports 42 or 44 for valve 10, ports 231 for valve 200, or mouth 450 for valve 400 as shown in FIG. 36. The valve is positioned within a chamber or compartment C in the inflatable device A and thus the port without a hose thereon is fluidly connected to this chamber C while the hose H extends to the bulkhead D and is connected (via known methods such as a barb or self gripping) to a hose barb or like connector within the bulkhead that is attached to a mechanical flange E for providing fluid flow into the other chamber or compartment B on the other side.

In this manner only one pump F is needed which snaps into a topping valve that is attached via threads 140 in valve spool 16 of the first embodiment or via threads 340 in valve spool 216 of the second embodiment. (Similarly in the third embodiment, only one pump is needed and it is attached via passage, 423 as is shown in FIG. 36 whereby no topping valve is present at this connection since it is, incorporated into the body). In the case of the first and second embodiments, if at least one set of ports is aligned, then pressurized fluid may be used to inflate at least one chamber while if both set of ports are aligned, then pressurized fluid may be used to inflate all chambers. Thus intercommunication or cross over occurs based upon port alignment. In the third embodiment, pressurized fluid automatically inflates the chamber connected to the passage 423 or 425 connected to the pump F. Intercommunication or cross over occurs by opening the cross over valve 400.

Accordingly, the improved invention is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved invention is constructed and used, the characteristics of the construction, and the advantageous, new and useful results obtained; the new and useful structures, devices, elements arrangements, parts and combinations, are set forth in the appended claims.

We claim:

1. A valve assembly for interconnecting a first fluid compartment to a second fluid compartment in an inflatable device, the valve assembly comprising:

a valve body attachable to the inflatable device, the valve body including a pair of passages therein, namely a first passage and a second passage that are substantially parallel to each other, where the first passage is connected to the first fluid compartment and the second passage is connected to the second fluid compartment, and the valve body further includes a pair of transverse air passages for selectively connecting the pair of passages, namely a first transverse air passage that intersects the first passage and a second transverse air passage that intersects the second passage, and the valve body even further including a third passage substantially parallel to the first and second passage, and whereby the first and second transverse air passages intersect the third passage; and a valve mechanism comprising a cross over valve seated within the third passage for fluidly connecting the pair of passages when desired to provide for fluid flow therebetween.

2. The valve assembly of claim 1 further comprising a first valve seated within the first passage, and a second valve seated with the second passage.

3. The valve assembly of claim 2 wherein the first and second transverse air passages intersect the third passage at different cross sectional locations along the third passage.

4. The valve assembly of claim 3 wherein the first and second valves are topping valves.

5. The valve assembly of claim 4 wherein the first and second valves are valves including poppet assemblies.

6. The valve assembly of claim 5 wherein each of the first and second valves includes a poppet, seal, spring and retainer.

7. The valve assembly of claim 6 wherein valve assembly is positioned within the first fluid compartment and a hose is connected from one of the pair of passages to the second fluid compartment.

8. The valve assembly of claim 7 wherein only one pump is connected to one of the pair of passages and is capable via the cross over valve of inflating both compartment.

9. A valve assembly for interconnecting a first fluid compartment to a second fluid compartment in an inflatable device, the valve assembly comprising a valve body attachable to the inflatable device, the valve body including a first passage and a second passage therein, where the first passage is connected at a first end to the first fluid compartment and at a second end includes a first valve therein, and the second passage is connected at a first end to the second fluid compartment and at a second end includes a second valve therein, and the valve body further including a third passage in which a cross over valve is positionable whereby the cross over valve selectively fluidly connects the first and second passages when desired for fluid flow therebetween, and the valve body even further including a first transverse air passage intersecting the first passage and the third passage, and a second transverse air passage intersecting the second passage and the third passage.

10. The valve assembly of claim 9 wherein the first and second transverse air passages intersect the third passage at different cross sectional locations along the third passage.

11. The valve assembly of claim 10 wherein the first and second valves are topping valves.

12. The valve assembly of claim 11 wherein the first and second valves are valves including poppet assemblies.

13. The valve assembly of claim 12 wherein each of the first and second valves includes a poppet, seal, spring and retainer.

14. The valve assembly of claim 13 wherein valve assembly is positioned within the first fluid compartment and a hose is connected from one of the part of passages to the second fluid compartment.

15. The valve assembly of claim 14 wherein only one pump is connected to one of the pair of passages and is capable via the cross over valve of inflating both compartments.

16. An inflatable device comprising:

a first fluid compartment;

a second fluid compartment separated from the first fluid compartment by a wall;

retainer ring;

a valve assembly positioned in an outer wall of the first fluid compartment so as to be sealed therein by a flange that is threaded to the retainer ring, wherein the valve assembly includes a valve body attachable to the inflatable device, the valve body including a first passage and a second passage therein, where the first passage is open at a first end to the first fluid compartment and at a second end includes a first valve therein, and the second passage is connected at a first end to a hose that connects to the wall and is fluidly connected to the second fluid compartment and at a second end includes a second valve therein, and the valve body further including a third passage in which a cross over valve is positionable whereby the cross over valve selectively fluidly connects the first and second passages when desired for fluid flow therebetween, and the valve body even further including a first transverse air passage intersecting the first passage and the third passage, and a second transverse air passage intersecting the second passage and the third passage.

17. The valve assembly of claim 16 wherein the first and second transverse air passages intersect the third passage at different cross sectional locations along the third passage.

18. The valve assembly of claim 17 wherein the first and second valves are topping valves.

19. The valve assembly of claim 18 wherein each of the first and second valves includes a poppet, seal, spring and retainer.

20. The valve assembly of claim 19 wherein valve assembly is positioned within the first fluid compartment and a hose is connected from one of the pair of passages to the second fluid compartment, and where only one pump is connected to one of the pair of passages and is capable via the cross over valve of inflating both compartment.

* * * * *